US006415444B1

(12) United States Patent
Kleinert

(10) Patent No.: US 6,415,444 B1
(45) Date of Patent: Jul. 9, 2002

(54) CATCHER'S MITT

(75) Inventor: James M. Kleinert, Glenview, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 09/923,163

(22) Filed: Aug. 6, 2001

Related U.S. Application Data

(63) Continuation-in-part of application No. 09/867,084, filed on May 29, 2001, which is a continuation of application No. 09/491,742, filed on Jan. 27, 2000, now Pat. No. 6,253,382.

(51) Int. Cl.[7] ..... A41D 19/00; A41D 13/08
(52) U.S. Cl. ..... 2/161.1; 2/19
(58) Field of Search ..... 2/19, 161.1, 159

(56) References Cited

U.S. PATENT DOCUMENTS

| | | | | | |
|---|---|---|---|---|---|
| 1,018,271 | A | * | 2/1912 | Rogers | 2/19 |
| 1,496,824 | A | * | 6/1924 | Nixon, Jr. | 2/19 |
| 2,528,802 | A | * | 11/1950 | Turner | 2/19 |
| 3,300,787 | A | * | 1/1967 | Denkert | 2/19 |
| 5,694,642 | A | * | 12/1997 | Rector et al. | 2/19 |

* cited by examiner

*Primary Examiner*—Rodney M. Lindsey
(74) *Attorney, Agent, or Firm*—Charles G. Lamb; Middleton Reutlinger

(57) ABSTRACT

A conventional baseball (softball) catcher's mitt includes an additional layer of protective padding in the areas above and below the center axis of rotation of the metacarpalphalangeal joint of the index finger. Additional protective padding may extend to the areas above and below the center axis of rotation of the metacarpalphalangeal joints of the long ring, and small fingers as well as the bony prominences of the thumb.

24 Claims, 15 Drawing Sheets

09923163

FIG. 9
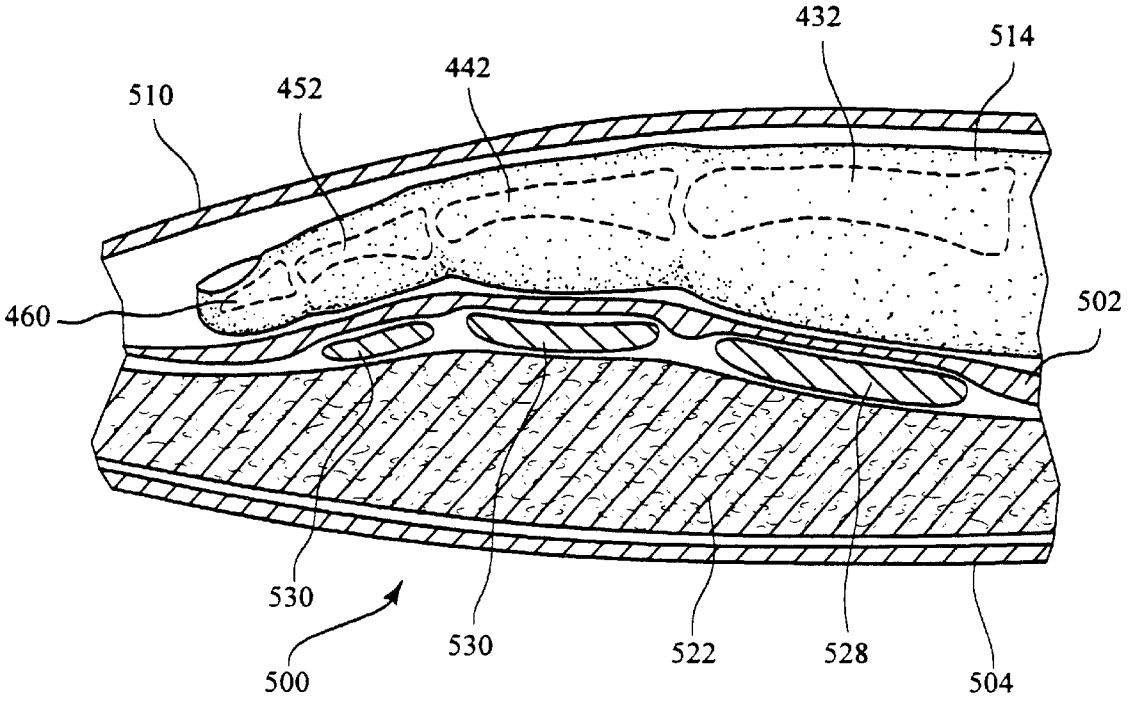
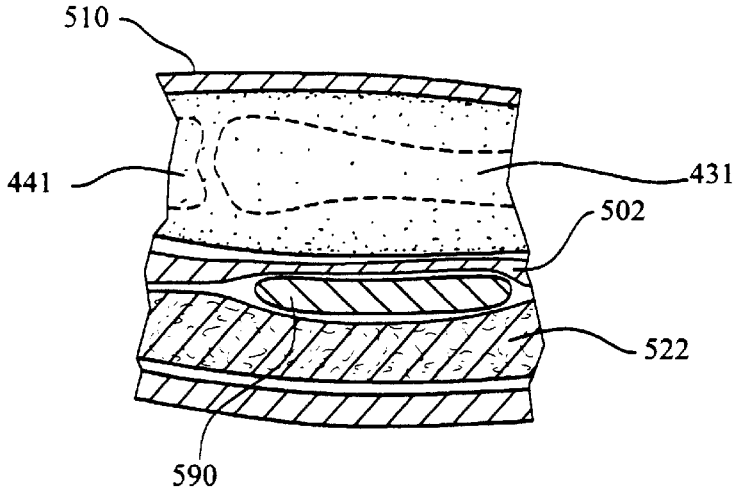
FIG. 11A

CATCHER'S MITT

CROSS REFERENCE TO RELATED APPLICATIONS

This is a continuation-in-part of U.S. patent application Ser. No. 09/867,084 filed May 29, 2001 which is a continuation of Ser. No. 09/491,742 filed Jan. 27, 2000 now U.S. Pat. No. 6,253,382.

BACKGROUND OF THE INVENTION

1. Field of the Invention

This invention relates to gloves for the human hand which are worn when playing sports such as baseball, softball, and the like. In one aspect, this invention relates to a batting glove specifically designed to improve grip, comfort, protection, and performance of a wearer. However, this invention has broader implications and may be advantageously employed in other applications requiring protection of the hands. More particularly, this invention relates to a catcher's mitt which includes additional padding in selected areas to provide additional protection of the hand during use by the wearer.

2. Description of Related Art

Glove construction for protection of the human hand is well known. In addition, there are a number of patents which teach gloves claimed to be particularly useful as batting gloves. For example, U.S. Pat. No. 3,175,226 teaches a dress glove construction which completely covers the fingers and which includes resiliently expandable materials in selected areas to accommodate hands of different sizes. In contrast, U.S. Pat. No. 4,561,122 teaches a protective glove which has a wrap around construction for a protective glove which leaves the thumb and fingers ends exposed. U.S. Pat. No. 5,345,609 teaches a protective glove which includes shock absorbing cells disposed at selected portions along the top of the glove. U.S. Pat. No. 5,790,980 teaches a hand glove with a polyurethane foam pad in the palm portion of the glove. Other references attempt to provide a sport glove for supporting and stabilizing the wrist and hand. Current gloves protect the bony prominence areas of the hand. Although hand protection from direct shocks and abrasions is found in gloves of the current art, what is needed is a batting glove which provides improved grip, comfort and performance by unloading bony prominences, unloading pulleys and tendons, and improving finger and knuckle motion of the hand of a wearer by providing preselected thicknesses of preselected materials specifically chosen to protect the wearer from injury from distributed shocks in hitting a ball with a bat, and the attendant risk of long-term injury to the aforementioned bones, ligaments, pulleys, tendons, etc., by repetitive swinging of bats and hitting of balls.

Also, catcher's mitt for use in baseball and fast pitch softball are well known. These mitts are generally constructed wherein the mitts are of generally circular configuration with a cut-out between a portion to receive a thumb of a wearer and the fingers of a wearer with webbing disposed between the thumb section and the finger section. Mitts are generally constructed to include padding to protect the hand of the wearer. However, very little consideration has been given to specific anatomical portions of the human hands to protect those anatomical portions which are more susceptible to injury when the wearer receives a hard thrown ball.

SUMMARY OF THE INVENTION

In the development of gloves, several key elements are utilized in the design. First, on the dorsal side of the glove, the motion zones are determined by the center axis of rotation of the individual thumb, finger, hand, and wrist joints. These motion zones have been applied to specific joint locations for the particular uses of a designed glove. This helps the flexibility of the glove in relationship to its use. As such, the motion zones are selected in various combinations or even individually depending on the specific task or function of the glove.

Secondly, on the palm side of the glove there are additional motion zones. Again, these motion zones, which also function to decrease glove impedance and improve the breath-ability of the glove, are located specifically in relationship to the center axis of rotation of the finger joints.

Thirdly, again on the palm side of the glove, there are specific areas of padding. The location of the padding is determined by the bone and joint anatomy of the hand, fingers, and thumb. For the hand, the palm pad is placed above the center axis of rotation of the wrist (i.e., just above or distal to the hook of the hamate) and just below the center axis of rotation of the metacarpal heads. These bony landmarks are actually quite prominent in relationship to the surface of the hand. By placing the pads between the bony prominences, these areas of the hand are unloaded. The type of pad chosen for the palm is specific to its function. Other applications require some adjustments to the pad, but the basic premise still remains to unload the bony prominences of the hand in relationship to the required object to be held.

The pads for the fingers are placed again between the bony prominences of each specific finger bone (phalanx). The individual pads of the digits are placed over the relatively flat portion of the phalanx and as such, between the joints that are present on each side of the respective phalanx. The pad does not cover the area near the center axis of rotation. Again, this unloads these bony areas and leads to more even distribution of force across the digit. In other words, decreased areas of concentrated pressure, i.e, over the bony prominences and individual phalanxes will experience less discomfort. Of course, improved comfort leads to better grip and performance of the specific task in question. The pads on the fingers are placed over the proximal and middle phalanx of each digit. Because of the relative bony and flexor tendon pulley anatomy, these regions correlate with the A2 and A4 pulleys specifically. Furthermore, this placement allows for unrestricted motion of the various finger and hand joints by precisely keeping the pads away from the center axis of rotation (for each specific joint). Depending on the use of the glove, various combinations, or even independent use of these pads could be utilized in glove construction. Additionally, the pads may have different sizes and shapes depending on the application. However, the pads would still be centered primarily between the bony prominences and away from the center axis of rotation for each joint.

The pad for the thumb is placed between the bony prominences of the first phalanx, primarily on the lateral (side) region. Again, the pad is located above the center axis of rotation of the metacarpalphalangeal joint of the thumb and below the center axis of rotation of the interphalangeal joint of the thumb. Other applications to this pad placement are quite numerous. Even this pad could be an application in combination with all, some, one, or none of the finger and palm pads depending on the task.

Optionally, pads may also be placed over the distal phalanx of each digit, just beyond the bony prominences. This pad would be above (distal) the center axis of rotation of the distal interphalangeal joint of the respective finger. As such, three pads could be placed over each finger depending on the use required for the glove.

The motion zone for the wrist area is also determined by the center axis of rotation of the wrist joint. This allows for essentially full motion of the wrist, while at the same time, avoiding dislodgement of the glove from the player's hand. Not all gloves require or benefit from a wrist motion zone. However, a combination of the finger, thumb, hand, and wrist motion zones determined by the joints center axis of rotation may be utilized for various glove applications.

An object of the present invention is to provide a batting glove which takes stress off of selected parts of the human hand.

Another object of the present invention is to provide a batting glove having preselected materials of construction in different areas of contact with the human hand.

A further object of the present invention is to provide a batting glove having preselected thicknesses of preselected materials of construction in different areas of contact with the human hand.

Yet another object of the present invention is to provide a batting glove which uses different materials to allow wrist motion, unload bony prominences, improve finger and knuckle motion, and protect the back of the hand.

Also, an object of the present invention is to provide a catcher's mitt which takes stress off of selected parts of the human hand when the mitt is in use.

Another object of the present invention is to provide a catcher's mitt with additional padding added to selected areas of the mitt for protecting selected anatomical portions of the human hand.

In one aspect, the present invention provides a batting glove including preselected material in preselected thicknesses to fill in the soft spots surrounding the bony prominences of the hand, to unload the pulleys and tendons, and to take stress off of selected parts of the hand. Specifically, 2-Way SPANDEX® materials are used in the wrist motion zone of the glove; thin elastic material such as LYCRA® is used in the area of the finger joints and knuckles; synthetic material such as JANEC SUPER® is used in the area of the dorsal side of the fingers; a cabretta skin protective covering is used for selected parts of the hand, rubber foam protective padding is placed at selected contact areas, and soft padding such as terry cotton is placed inside the glove in selected areas.

More particularly, the present invention provides a baseball (softball) catcher's mitt which includes a top portion and a bottom portion secured along outer peripheries of each portion to define a mitt body with an opening therebetween to receive a human hand with a thumb stall and a plurality of finger stalls for receiving a thumb and fingers of the human hand. Within the mitt body is a first layer of protective padding which is dispersed throughout the mitt body with the concentration of the padding being along the outer periphery. The bottom portion is also provided with a second layer of protective padding attached at selected areas thereof. The selected areas are defined by the location of anatomical parts of the human hand when inserted into the mitt. Specifically, the second layer of protective padding, which is usually a foam rubber or another foamed elastomeric material includes at least a first area above and a second area below the center axis of rotation of a proximal interphalangeal joint of an index finger. Other areas of the second layer of protective padding may be added above the center axis of rotation of the wrists and just below the center axis of rotation of the metacarpal heads. Moreover, the second layer of protective padding may be placed over the areas which cover other specific phalanxes including the relative flat portion of the phalanxes and as such, between the joints that are present on each side of the respective phalanx, but leaving open the area of and around the center axis of rotation of the joint. Other areas which may also include this second layer of protective padding, may include the area which overlies the proximal phalanx of the thumb between the bony prominences and an area which overlies the bony prominences of the thumb proximal phalanx, between the proximate and distal ends of the thumb proximal phalanx.

It is realized that in describing the instant invention as a baseball catcher's mitt, such term includes a softball catcher's mitt as well. And, further objects and advantages of this invention will appear from the following description and appended claims, reference being had to the accompanying drawings forming a part of the specification wherein like reference characters designate corresponding parts into several views.

BRIEF DESCRIPTION OF THE DRAWINGS

A better understanding of the invention will be had upon reference to the following description in conjunction with the accompanying drawings in which like numerals refer to like parts throughout the several views and wherein:

FIG. 9 is a sectional view taken along lines 9—9 of FIG. 6 showing selected locations for protective padding in a catcher's mitt;

FIG. 11A is a sectional view taken along lines 11A—11A of FIG. 11.

DESCRIPTION OF THE PREFERRED EMBODIMENTS

A. Batting Glove

Figure 1:
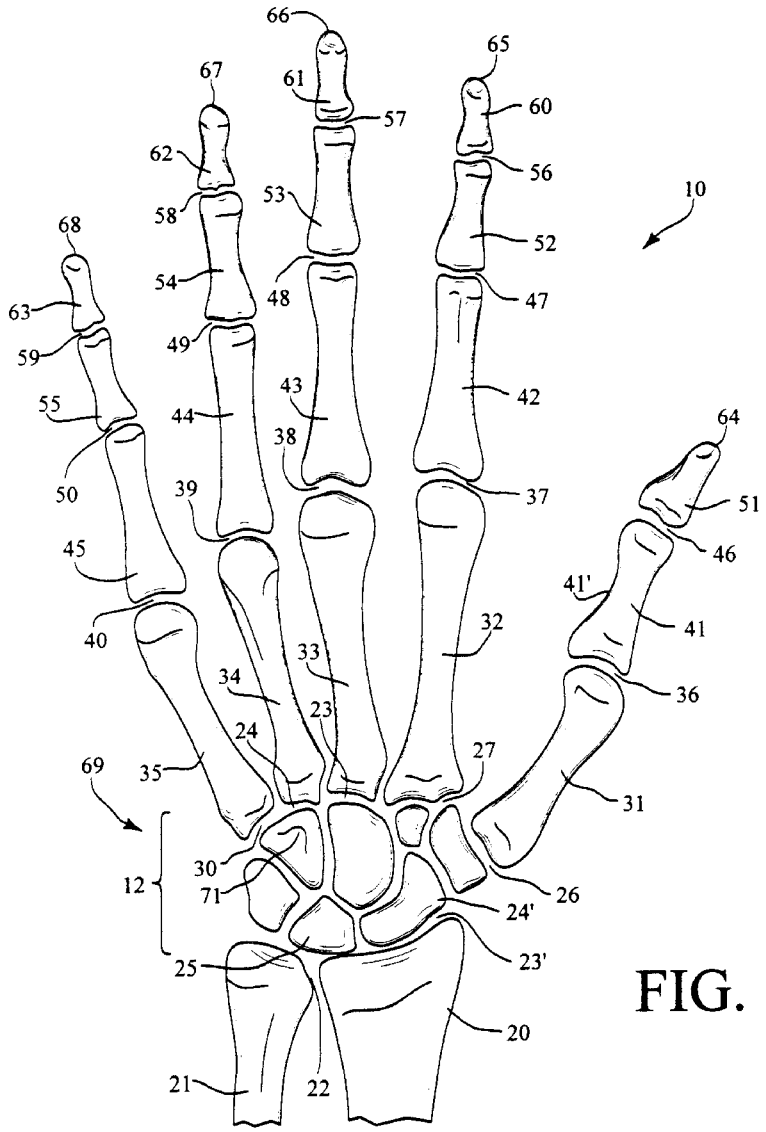
FIG. 1 is a bottom schematic anatomical view of the bones of a right-side human hand showing the palm-side details.

FIG. 1 is a schematic anatomical view of the bones of a right human hand 10 looking at a palm 18 side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 1A:
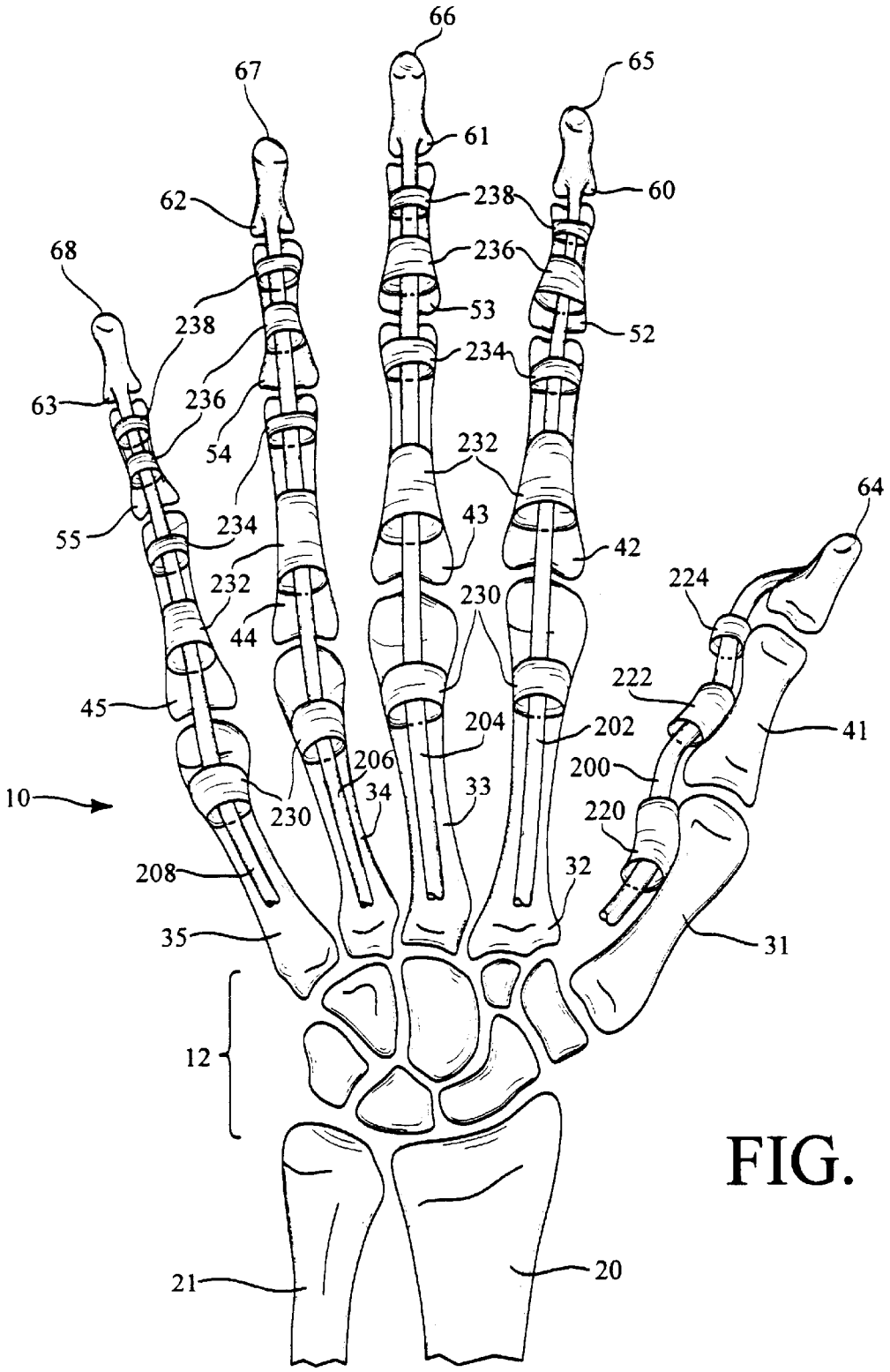
FIG. 1A is a bottom schematic anatomical palm-side view of the bones, and selected details of the pulleys and tendons of a right-side human hand.

FIG. 1A shows the skeletal anatomy, pulley system, and flexor tendons of the thumb 64 and fingers 65–68 of the right hand 10. The thumb 64 includes the flexor tendon (flexor pollicis longus) 200 and the three pulleys 220–224 of the thumb 64; an A1 pulley 220, A2 pulley 222, and A3 pulley 224. The A2 pulley 222 is the most important for function and is attached to the proximal phalanx 41 of the thumb 64. The respective pulleys 230–238 are also shown for each of the: index finger 65, long finger 66, ring finger 67, and small finger 68. Each finger 65–68 has five pulleys 230–238; an A1 pulley 230, A2 pulley 232, A3 pulley 234, A4 pulley 236, and A5 pulley 238. The A2 pulley 232 and A4 pulley 236 are considered to be the most important for function. The A2 pulley 232 is attached to the proximal phalanx 42–45. The A4 pulley 236 is attached to the middle phalanx 52–55. The A1 pulley 230 is near the MCP joint 37–40, the A3 pulley 234 is near the PIP joint 46–50 and the A5 pulley 238 is near the DIP joint 56–59.

Figure 4:
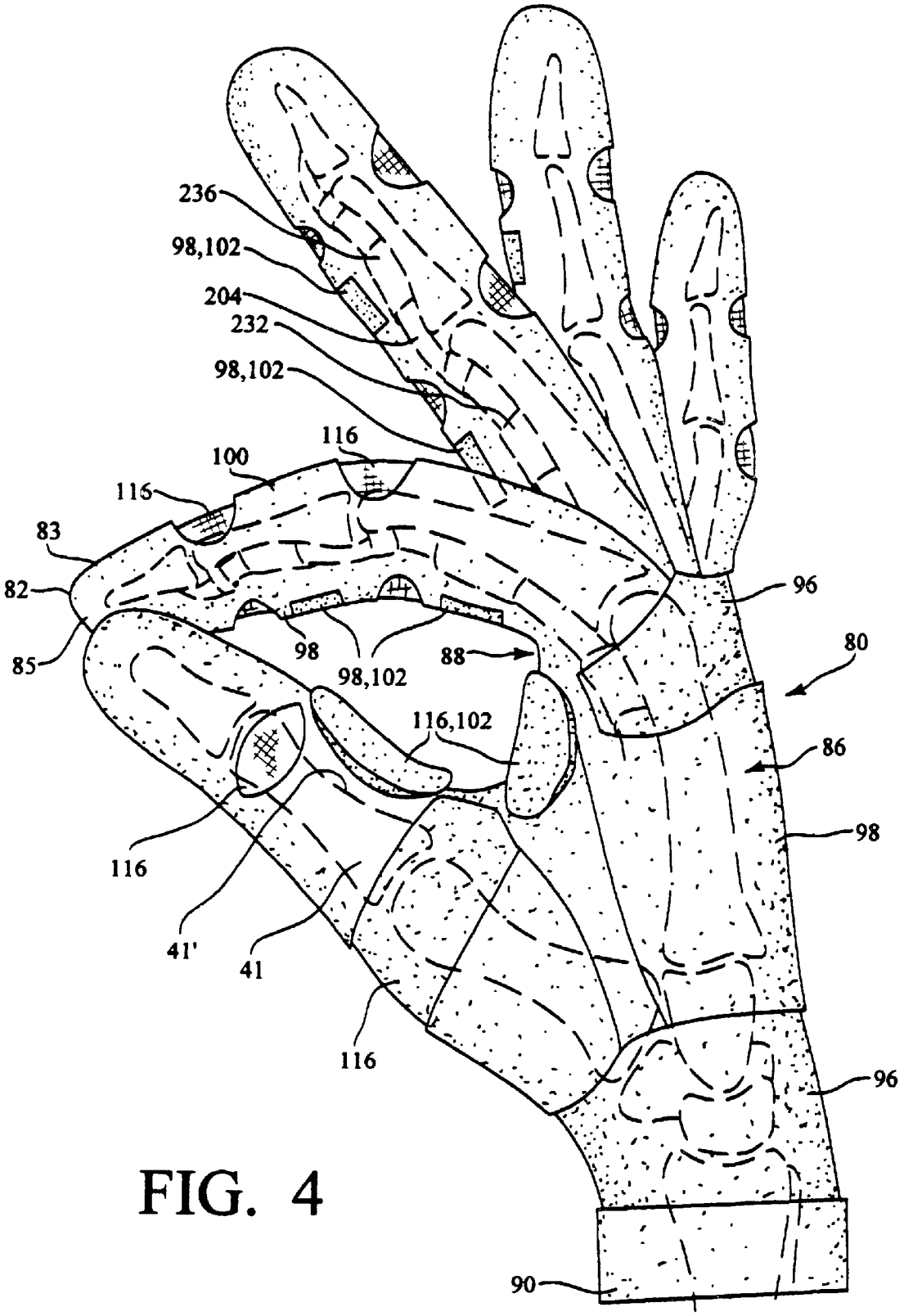
FIG. 4 is a radial side view of a batting glove of a preferred embodiment of the present invention showing relevant details and seen overlaying the skeletal structure of a right-side human hand.

The flexor tendons 202–208 are shown as one unit for each finger 65–68, but actually there are two flexor tendons to each unit. They are the flexor digitorum superficialis and the flexor digitorum profundus (shown as one, 202–208). These tendons 202–208 travel underneath the pulleys 230–238 and the flexor digitorum profundus tendon attaches to the distal phalanx 60–63 of each finger 65–68. The tendons 202–208 move back and forth below the pulleys 230–238, via muscles (not shown) attached to the proximal end of the tendons. This movement of the tendon 202–208 produces finger 65–68 flexion. The pulleys 230–238 prevent the flexor tendons 202–208 from bowstringing or moving away from the bone with finger 65–68 flexion. If the pulleys 230–238 are damaged and no longer function, the tendons 202–208 will bowstring with a resultant significant loss of finger motion as well as grip strength. As such, pulleys 230–238, especially the A2 pulley 232 and the A4 pulley 236, are very important and must be preserved and protected as much as possible. As shown in FIG. 4, protective padding 102 for each finger 65–68 is placed in an anatomically designed fashion over the A2 and A4 pulley regions. When the A2 and A4 pulleys 232 and 236 are preserved, adequate finger 65–68 motion and grip strength is maintained.

In FIGS. 2–5, a preferred batting glove 80 is provided for either a right, left, or both human hand(s) 10, as desired. A glove 80 for a left hand 10 utilizes symmetrical placement of the elements, materials, and thicknesses herein described.

Figure 2:
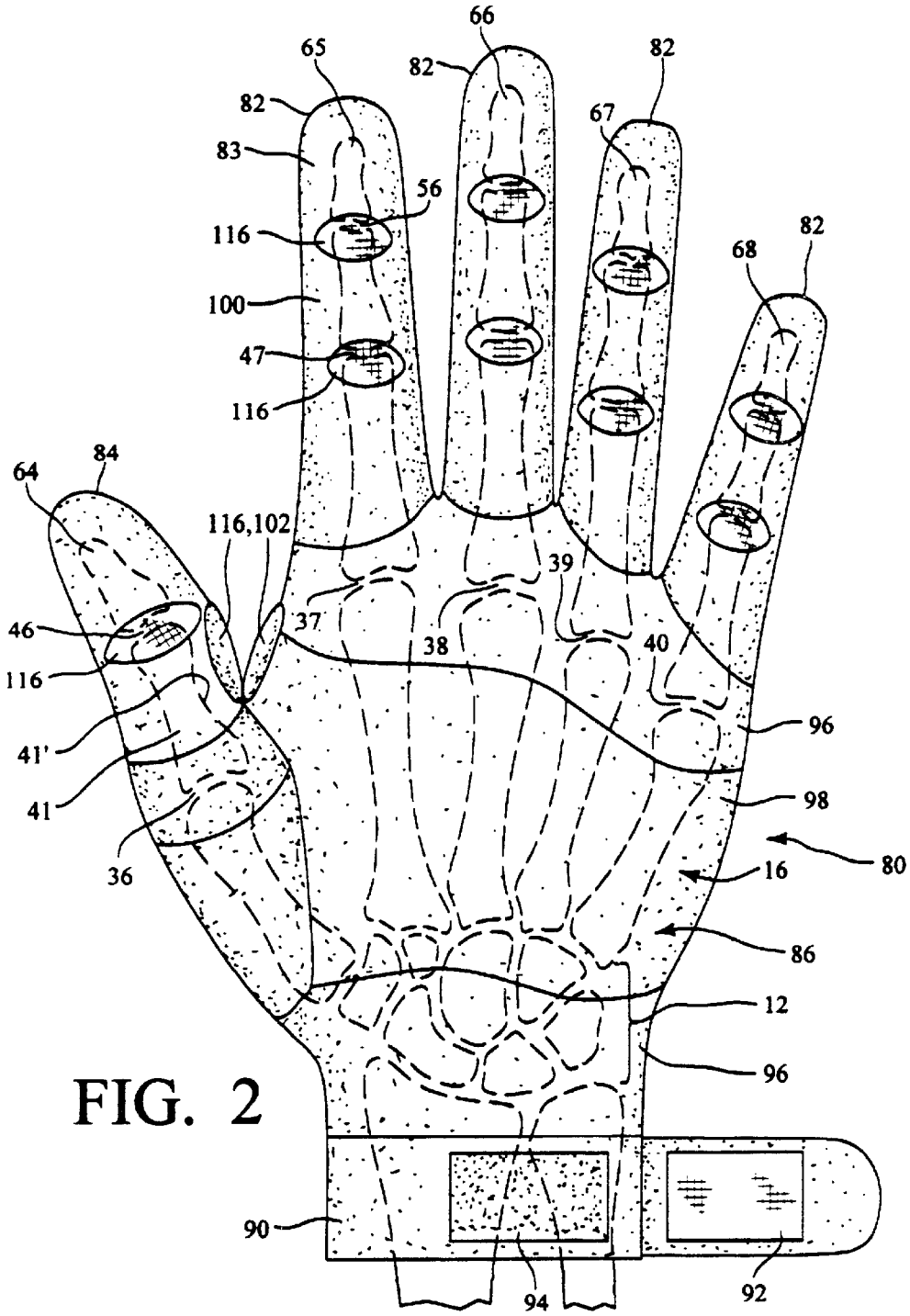
FIG. 2 is a top view of a batting glove of a preferred embodiment of the present invention showing the dorsal-side details and seen overlaying the skeletal structure of a right-dorsal-side human hand.

FIG. 2 shows details of a dorsal side of a batting glove 80 to cover a human hand 10 and seen overlaying the skeletal structure and skin outline of a right-dorsal-side human hand 10.

The batting glove 80 has a plurality of finger elements 82, a thumb element 84, a top portion 86, and a lower portion 88 (see FIGS. 3–5), wherein the finger elements 82 cover fingers 65–68. The thumb element 84 covers a thumb 64, and the top portion 86 covers a back side 16 of the hand 10. The lower portion 88 covers the palm side 18 of the hand 10.

An elastic band 90 is attached to the top portion 86 and to the lower portion 88. The elastic band 90 includes a securing means in the form of a hook 92 and loop 94 fastener for retention above a human wrist 12.

The top portion 86 includes elastic material 96, preferably 2-WAY SPANDEX® in the vicinity of the wrist 12 out to the vicinity of the metacarpalphalangeal joints (MCP) 37–40 of the fingers 65–68 of the hand 10. Additionally, a protective covering 98 is centrally located to cover the back side 16 of the hand 10.

The finger elements 82 each include an upper portion 83 which includes synthetic material 100 with openings formed therein to receive thin elastic material 116 attached to cover the proximal interphalangeal joints (PIP) 47–50, and the distal interphalangeal joint (DIP) 56–59 of each finger 65–68.

Figure 3:
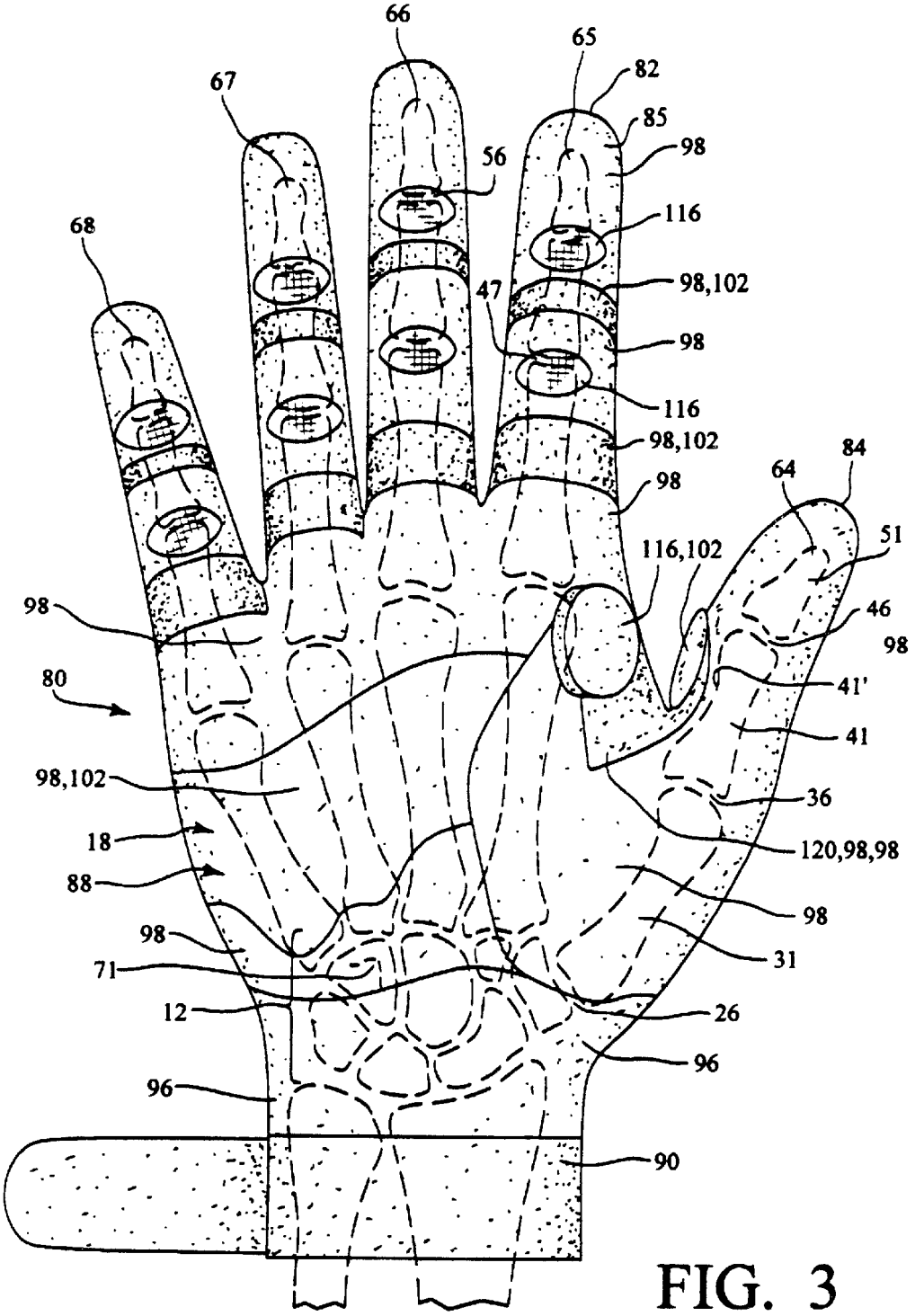
FIG. 3 is a bottom view of a batting glove of a preferred embodiment of the present invention showing the palm-side details and seen overlaying the skeletal structure of a right-palm-side human hand.

As shown in FIG. 3, a lower portion 85 of the finger elements 82 includes protective covering 98. In addition, protective padding 102 is affixed beneath the protective covering 98 and adjacent to the fingers 65–68, in preselected areas. As shown in FIGS. 3 and 4, protective padding 102 and protective covering 98 cover the middle phalanx 52–55—specifically the A4 pulley 236 region, and the proximal phalanx 42–45—specifically the A2 pulley 232 region, of each finger 65–68. Openings are formed in the lower portion 85 to receive thin elastic material 116 attached to cover the palm-side 18 of the proximal interphalangeal joints (PIP) 47–50, and the distal interphalangeal joints (DIP) 56–59 of each finger 65–68.

The thumb element 84 includes protective covering 98 which surrounds the distal phalanx 51, metacarpalphalangeal joint (MCP) 36, proximal phalanx 41, metacarpal 31, and carpometacarpal joint (CMC) 26 of the thumb 64. As shown in FIG. 2, an opening is formed in the protective covering 98 to receive thin elastic material 116 attached to cover the interphalangeal joint (IP) 46 of the thumb 64. Another opening is formed in the protective covering 98 over the metacarpalphalangeal joint (MCP) 36 to receive thin elastic material 116. As shown in FIGS. 2–5, a piece of protective padding 102, which is itself covered by thin elastic material 116, is affixed to an area on the thumb element 84 and centered on an ulnar border (inside) of the thumb 64 over the diaphysis of proximal phalanx 41' of the thumb 64. The diaphysis of proximal phalanx 41' is found between the metacarpalphalangeal joint (MCP) 36 and interphalangeal joint (IP) 46 of the thumb 64.

Referring again to FIG. 3, the bottom portion 88 includes elastic material 96 in the vicinity of the wrist 12. Out from the wrist 12 area, the bottom portion 88 includes protective covering 98 continuing out to the vicinity of the metacarpalphalangeal joints (MCP) 36–40 and located to cover the palm 18 of the hand 10. A piece of protective padding 102 is affixed to a central palm 18 area underneath the protective covering 98 and placed at a preselected distance below a center axis of rotation of the metacarpalphalangeal joints (MCP) 37–40 and extending to a preselected distance above the hook of the hamate 71.

Figure 3A:
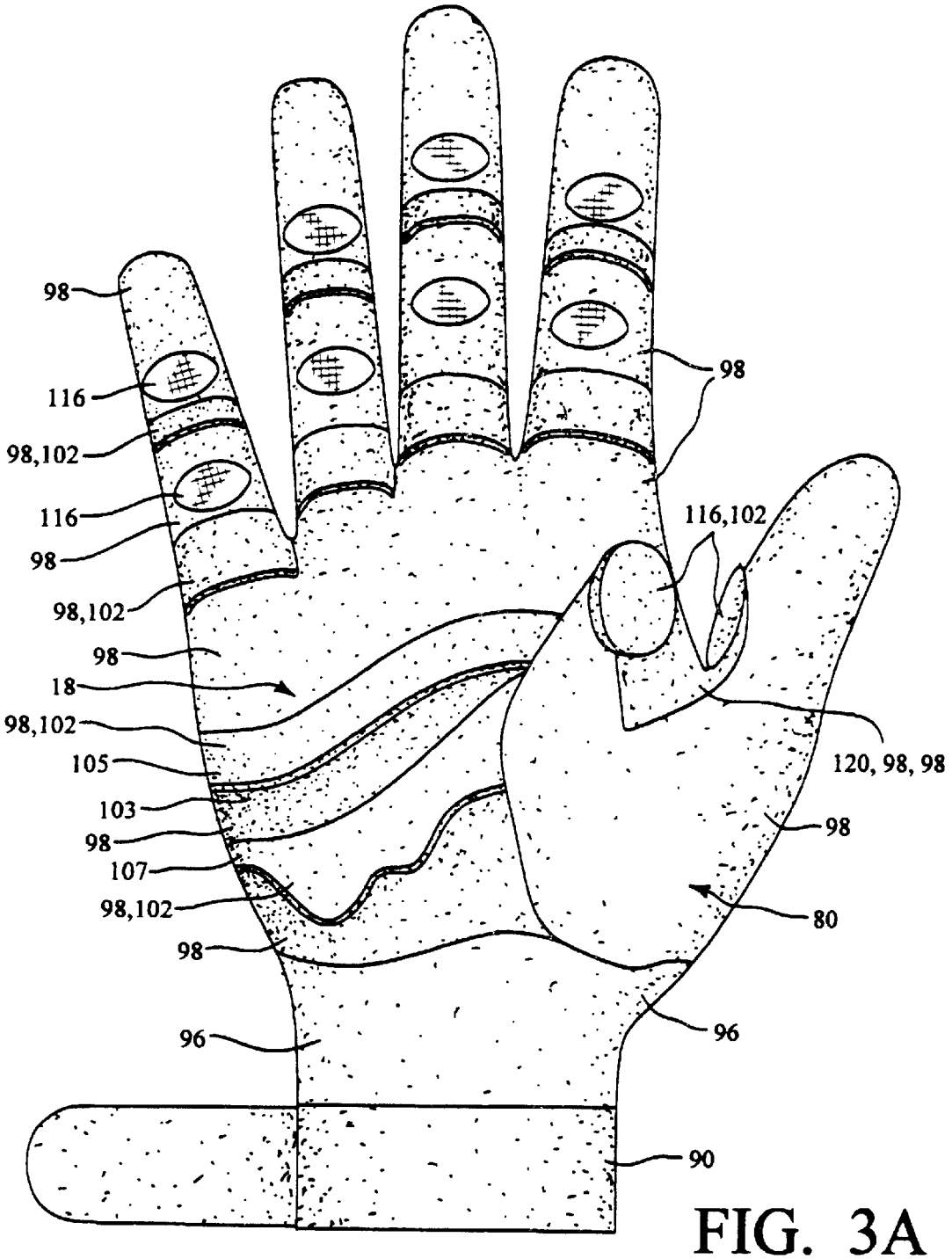
FIG. 3A is a bottom view of another batting glove of a preferred embodiment of the present invention showing relevant palm-side details.

As shown in FIG. 3A, another preferred embodiment of the batting glove 80 is similar to the glove 80 of FIG. 3, but is distinguished wherein a central portion 103 of the central palm 18 area is provided having no protective padding 102 and abutting two separate sections, a first section 105, and a second section 107. Both the first section 105 and the second section 107 include affixing protective padding 102 underneath the protective covering 98. The central portion 103 includes protective covering 98, but no protective padding 102. When viewed as in FIG. 3A, an overall outline of the central palm 18 area is similar to that of the glove of FIG. 3, except that the central portion 103 appears to be relieved or depressed in relation to the first section 105 and the second section 107.

Referring back to FIG. 3, a first web 120 is formed in the area where the thumb element 84 is in proximity to the index finger 65. An additional piece of protective covering 98 (thereby creating a double thickness of protective covering 98) is affixed over the first web 120. A piece of protective padding 102 covered by thin elastic material 116 is affixed over the additional piece of protective padding 98 over the first web 120 to cover an area which is contacted by protective padding 102 of the thumb element 84. When the glove 80 is worn by a wearer, the bottom portion 88 contacts the remainder of the palm 18.

Figure 5:
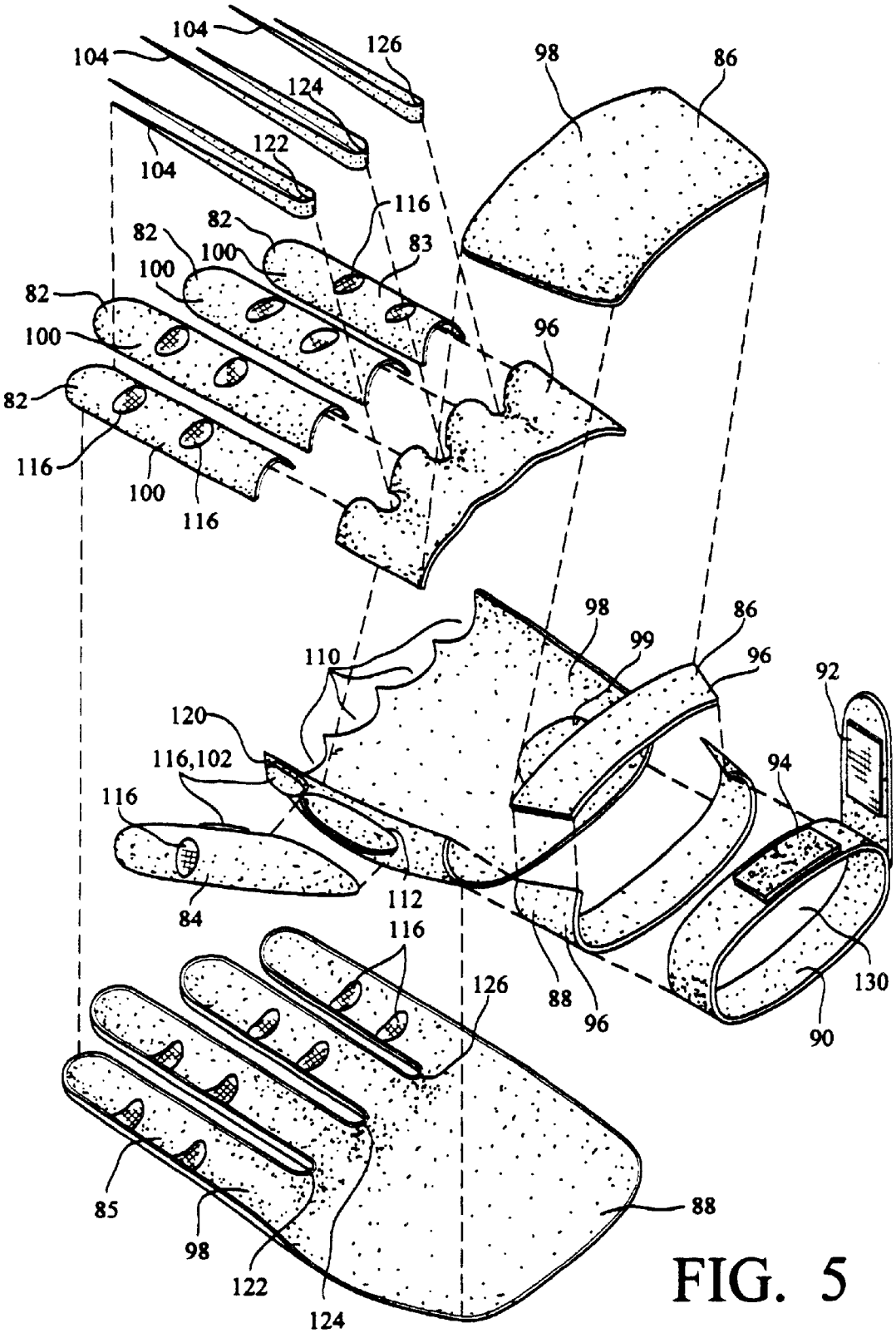
FIG. 5 is an exploded view of some of the major components of a batting glove of a preferred embodiment of the present invention.

Referring to FIG. 5, the bottom portion 88 is attached to the top portion 86 to enable an entire covering of the palm 18 and the back side 16 of the hand 10 along an outer periphery having at selected locations a plurality of finger openings 110, a thumb opening 112, and a main opening 130. Second, third and fourth webs, 122, 124, and 126, respectively, are formed between adjacent fingers 65–68. The finger elements 82 are fixedly attached to each of the finger openings 110. The batting glove 80 further provides the finger elements 82 with elastic webbing material 104 affixed laterally therebetween beginning at a tip of the index finger 65 down to the second web 122, running up to the long finger 66 and continuing likewise terminating at the tip of the small finger 68 just past the fourth web 126. Soft padding 99 such as terry cotton is placed as desired inside of the batting glove to cover the thicker protective padding 102, preferably in the areas of the palm 18 and pulleys of the fingers 65–68, and to provide for the comfort of the wearer.

Materials used in manufacture are preselected to achieve various goals as follows:

- Synthetic material 100, such as, for example, JANEC SUPER® is used dorsally over the fingers 65–68 of the hand 10;
- 2-Way Elastic material 96, such as, for example, 2-WAY SPANDEX® is used in motion zones of the hand 10 to allow glove 80 movement;
- Thin elastic material 116, such as, for example, LYCRA® is used to cover areas on the glove 80 based on centers of axes of rotation of all joints of the fingers 65–68 and thumb 64 of the hand 10;
- Protective covering 98, such as, for example, cabretta skin (Indonesian sheep skin) is used to provide for protection from abrasion and direct shock applied to the hand in gripping a bat (not shown) and hitting a ball (not shown) with the bat; and,
- Protection padding 102, such as, for example, rubber foam of 1/16" in thickness, is used to enhance a gripping surface of he fingers 65–68, specifically the regions of the A2 pulley 232 and A4 pulley 236, and in the palm 18 and first web 120 in order to reduce the most severe of shocks transmitted to the hand 10.

The disclosure given is applicable not only to batting gloves, but also to gloves intended for use in various other activities such as, for example, golf, and working in the outdoors to include gardening. Protection for the hands 10 during use in such activities is achieved by measures such as, for example, varying quantity, placement, thickness, dimensions, and elastic qualities of pads, coverings, elastic materials and openings, as appropriate.

B. Catcher's Mitt

Figure 7:
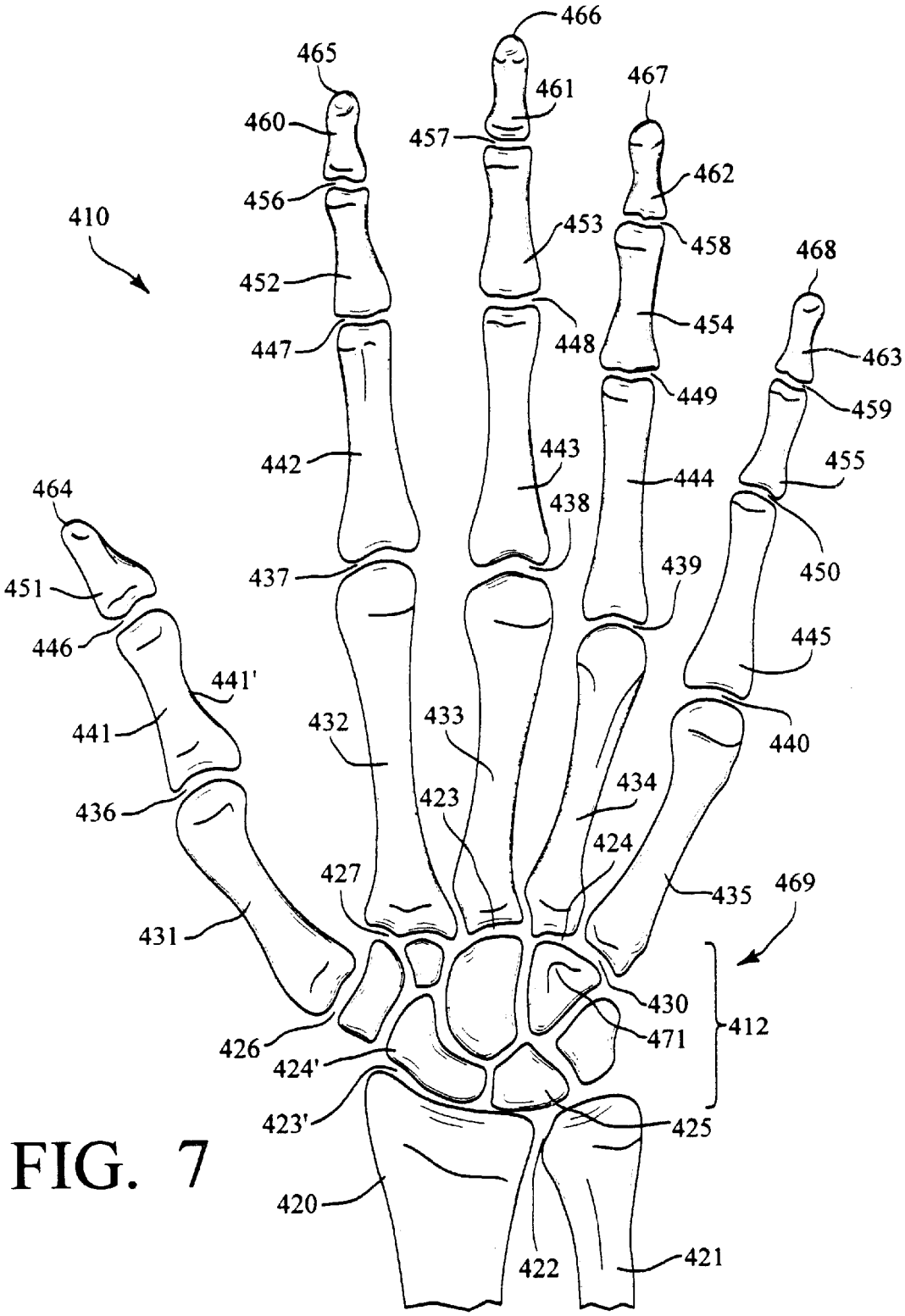
FIG. 7 is a bottom schematic anatomical view of a left human hand showing the palm-side detail.

FIG. 7 is a schematic anatomical view of the bones of a left human hand 410 looking at a palm 418 side. Shown are the radius 420, ulna 421, radiocarpal joint (RC) 423', distal radio ulnar joint (DRUJ) 422, wrist 412, thumb 464, index finger 465, long finger 466, ring finger 467, and small finger 468. Also shown is a carpus 469 which comprises eight carpal bones, seven of which are shown in FIG. 7. This includes the hamate bone 471 with its hook-like protrusion, the scaphoid 424' and the lunate 425.

The thumb 464 is comprised of the distal phalanx 451, the interphalangeal joint (IP) 446, proximal phalanx 441, diaphysis of proximal phalanx 441', metacarpalphalangeal joint (MCP) 436, metacarpal 431, and carpometacarpal joint (CMC) 426.

The index finger 465 is comprised of the distal phalanx 460, distal interphalangeal joint (DIP) 456, middle phalanx 452, proximal interphalangeal joint (PIP) 447, proximal phalanx 442, metacarpalphalangeal joint (MCP) 437, metacarpal 432, and carpometacarpal joint (CMC) 427.

The long finger 466 is comprised of the distal phalanx 461, distal interphalangeal joint (DIP) 457, middle phalanx 453, proximal interphalangeal joint (PIP) 448, proximal phalanx 443, metacarpalphalangeal joint (MCP) 438, metacarpal 433, and carpometacarpal joint (CMC) 423.

The ring finger 467 is comprised of the distal phalanx 462, distal interphalangeal joint (DIP) 458, middle phalanx 454, proximal interphalangeal joint (PIP) 449, proximal phalanx 444, metacarpalphalangeal joint (MCP) 439, metacarpal 434, and carpometacarpal joint (CMC) 424.

The small finger 468 is comprised of the distal phalanx 463, distal interphalangeal joint (DIP) 459, middle phalanx 455, proximal interphalangeal joint (PIP) 450, proximal phalanx 445, metacarpalphalangeal joint (MCP) 440, metacarpal 435, and carpometacarpal joint (CMC) 430.

Figure 7A:
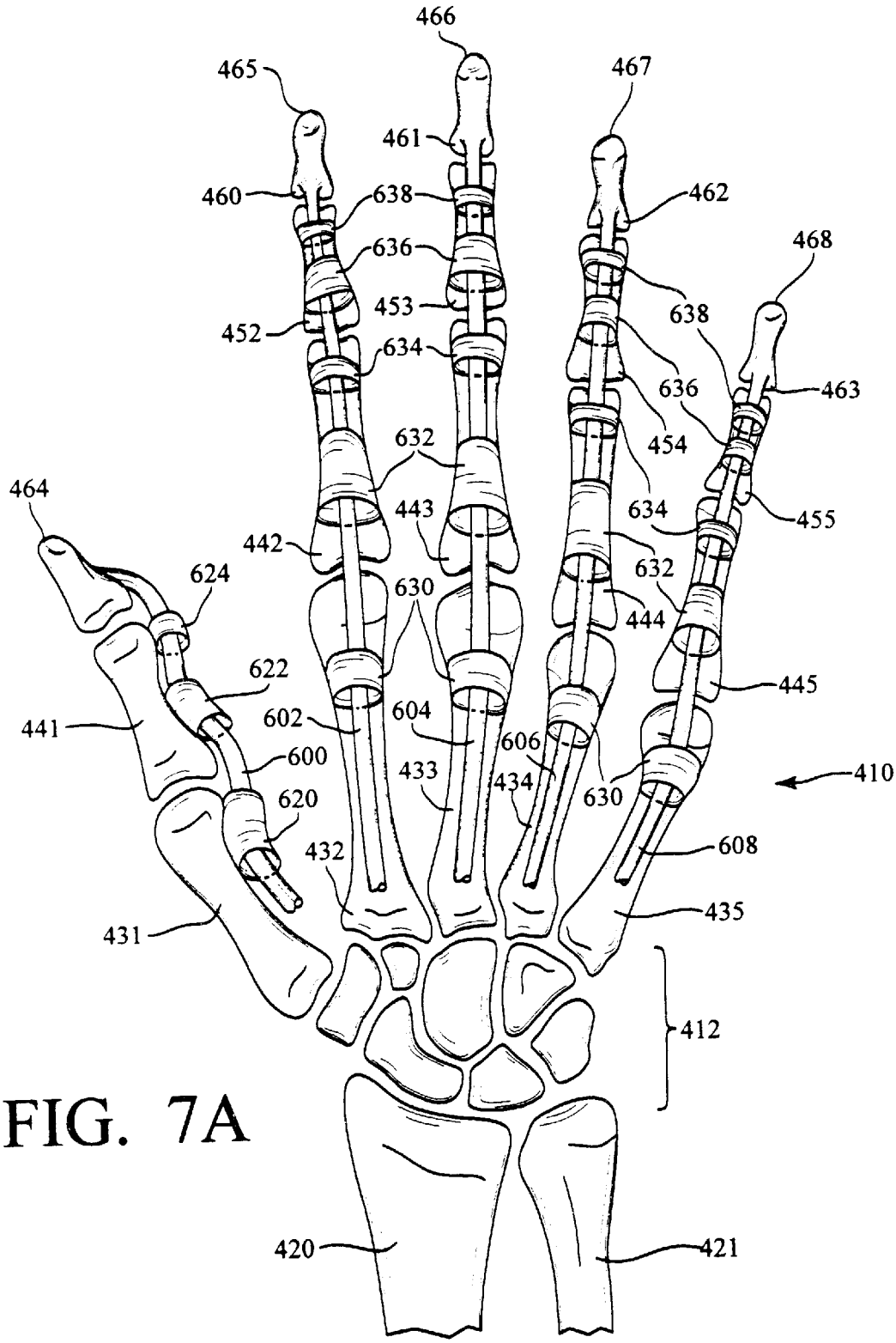
FIG. 7A is a bottom schematic anatomical side view of the bones and selected details of the pulleys and tendons of a left human hand.

FIG. 7A shows the skeletal anatomy, pulley system, and flexor tendons of the thumb 464 and fingers 465–468 of the left hand 410. The thumb 464 includes the flexor tendon (flexor pollicis longus) 600 and the three pulleys 620–624 of the thumb 464; an A1 pulley 620, A2 pulley 622, and A3 pulley 624. The A2 pulley 622 is the most important for function and is attached to the proximal phalanx 441 of the thumb 464. The respective pulleys 630–638 are also shown for each of the: index finger 465, long finger 466, ring finger 467, and small finger 468. Each finger 465–468 has five pulleys 630–638; an A1 pulley 630, A2 pulley 632, A3 pulley 634, A4 pulley 636, and A5 pulley 638. The A2 pulley 632 and A4 pulley 636 are considered to be the most important for function. The A2 pulley 632 is attached to the proximal phalanx 442–445. The A4 pulley 636 is attached to the middle phalanx 452–455. The A1 pulley 630 is near the MCP joint 437–440, the A3 pulley 634 is near the PIP joint 446–450 and the A5 pulley 638 is near the DIP joint 456–459.

The flexor tendons 602–608 are shown as one unit for each finger 465–468, but actually there are two flexor tendons to each unit. They are the flexor digitorum superficialis and the flexor digitorum profundus (shown as one, 602–608). These tendons 602–608 travel underneath the pulleys 630–638 and the flexor digitorum profundus attaches to the distal phalanx 460–463 of each finger 465–468. The tendons 602–608 move back and forth below the pulleys 630–638, via muscles (not shown) attached to the proximal end of the tendons. This movement of the tendon 602–608 produces finger 465–468 flexion. Protective padding, as discussed hereinafter, is placed in an anatomically designed fashion over the A2 and A4 pulley regions. When the A2 and A4 pulleys 632 and 636 are preserved, adequate finger motion and grip strength is maintained.

In FIGS. 6 and 8–10, a first preferred catcher's mitt 500 is provided for the left human hand. The catcher's mitt 500 includes a top and bottom wall designated 502 and 504, respectively, of suitable material, such as leather. The top and bottom walls are secured along the outer periphery of the mitt, usually by lacing, to form a generally circular mitt body 508. A first layer of padding 522 is provided between the top and bottom walls 502 and 504 of the mitt 500 for protection of the hand which is well known to those skilled in the art. This first layer is concentrated or thickest along the outer periphery. A webbing 501 is attached to the mitt body 508, also in a conventional and well known manner.

A top panel member 510 is secured, usually by stitching, to the bottom wall 504 of the mitt 500 for covering the back of the hand. This panel member 510 is formed in the shape of a hand and in conjunction with the top wall 502 includes finger stalls 514, 516, 518, and 520, for receiving the fingers of a hand and a thumb stall 512 for receiving the thumb. It is realized that the finger stalls 514, 516, 518 and 520 may be separated individually or in some instances a plurality of the finger stalls may be provided in a single stall to receive a plurality of fingers therein. The finger stalls 514, 516, 518, and 520 are designed for the location of the fingers of the human hand when inserted into the mitt 500.

Panel member 510 is usually a flexible sheet material, such as leather, and may comprise a plurality of pieces sewn together or may be of unitary construction and sewn together to form the stalls with a hand opening 536 (FIG. 6) in which the hand may be inserted between the top panel member 510 and the bottom wall 502 with the fingers being received in the finger stalls 514, 516, 518, 520 and the thumb in the thumb stall 512.

Figure 6:
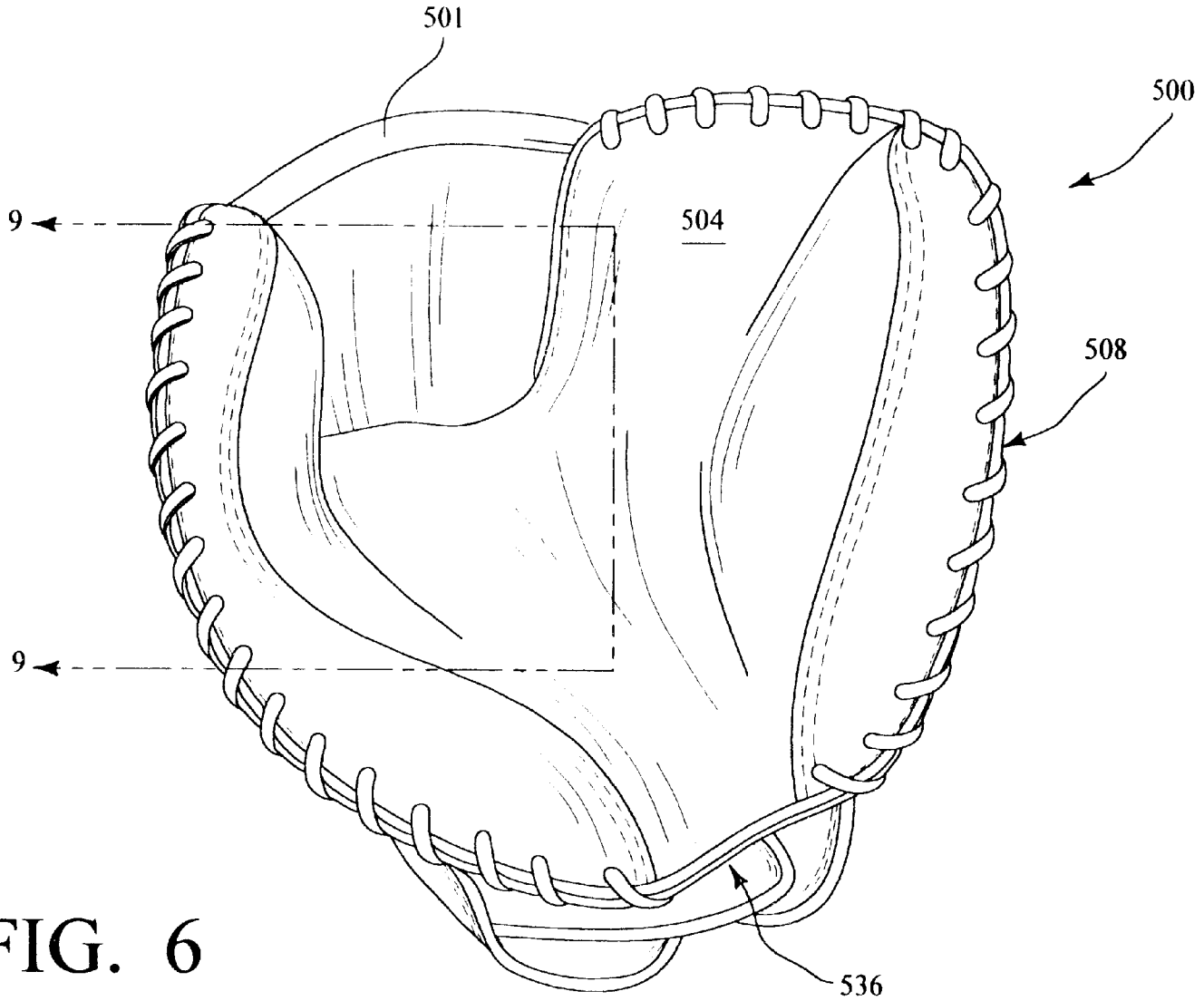
FIG. 6 is a top view of a catcher's mitt.
Figure 8:
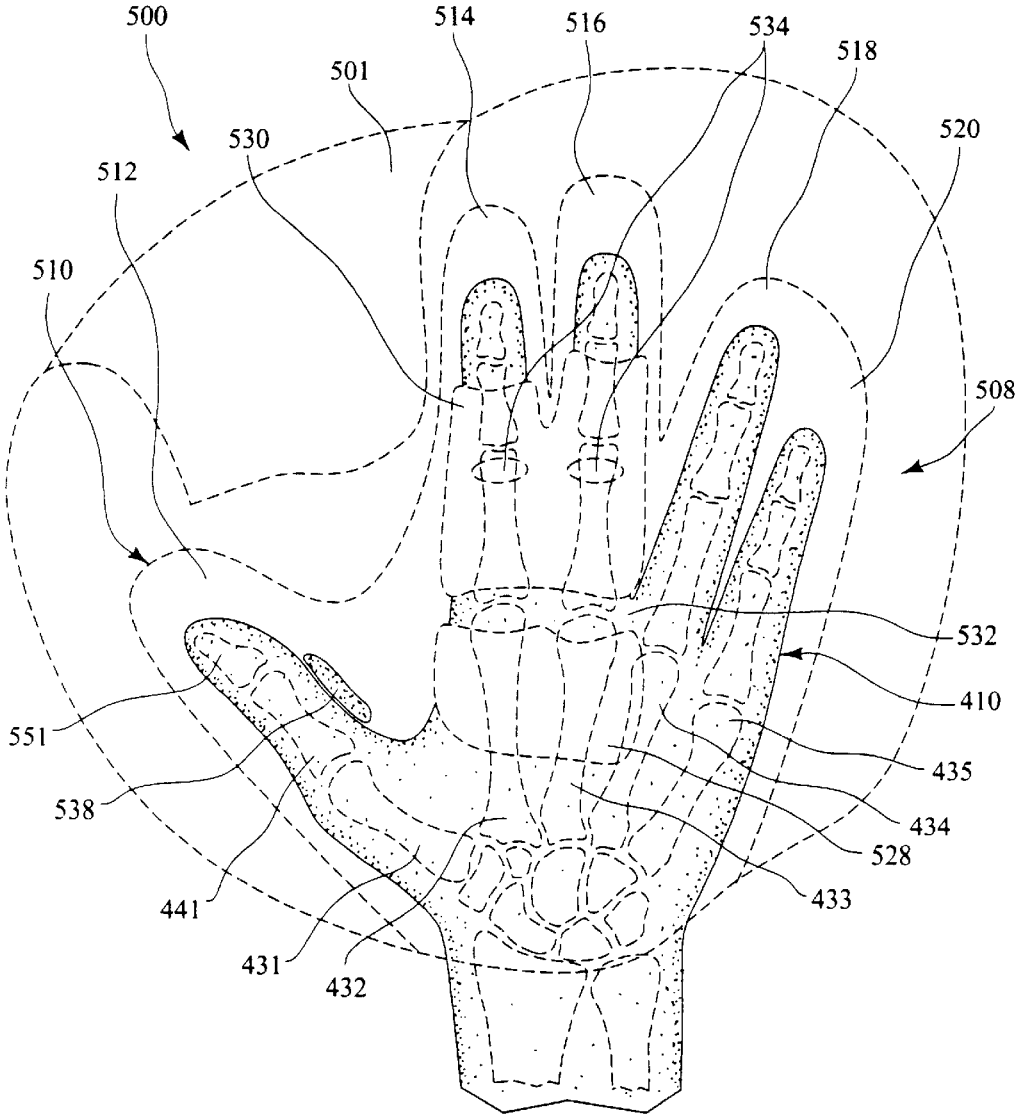
FIG. 8 is a top view of a first preferred embodiment of a catcher's mitt showing the palmar-side details and seen overlaying the skeletal structure of a left-palmar-side human hand inserted into the catcher's mitt with the outline of the catcher's mitt shown in phantom lines.
Figure 10:
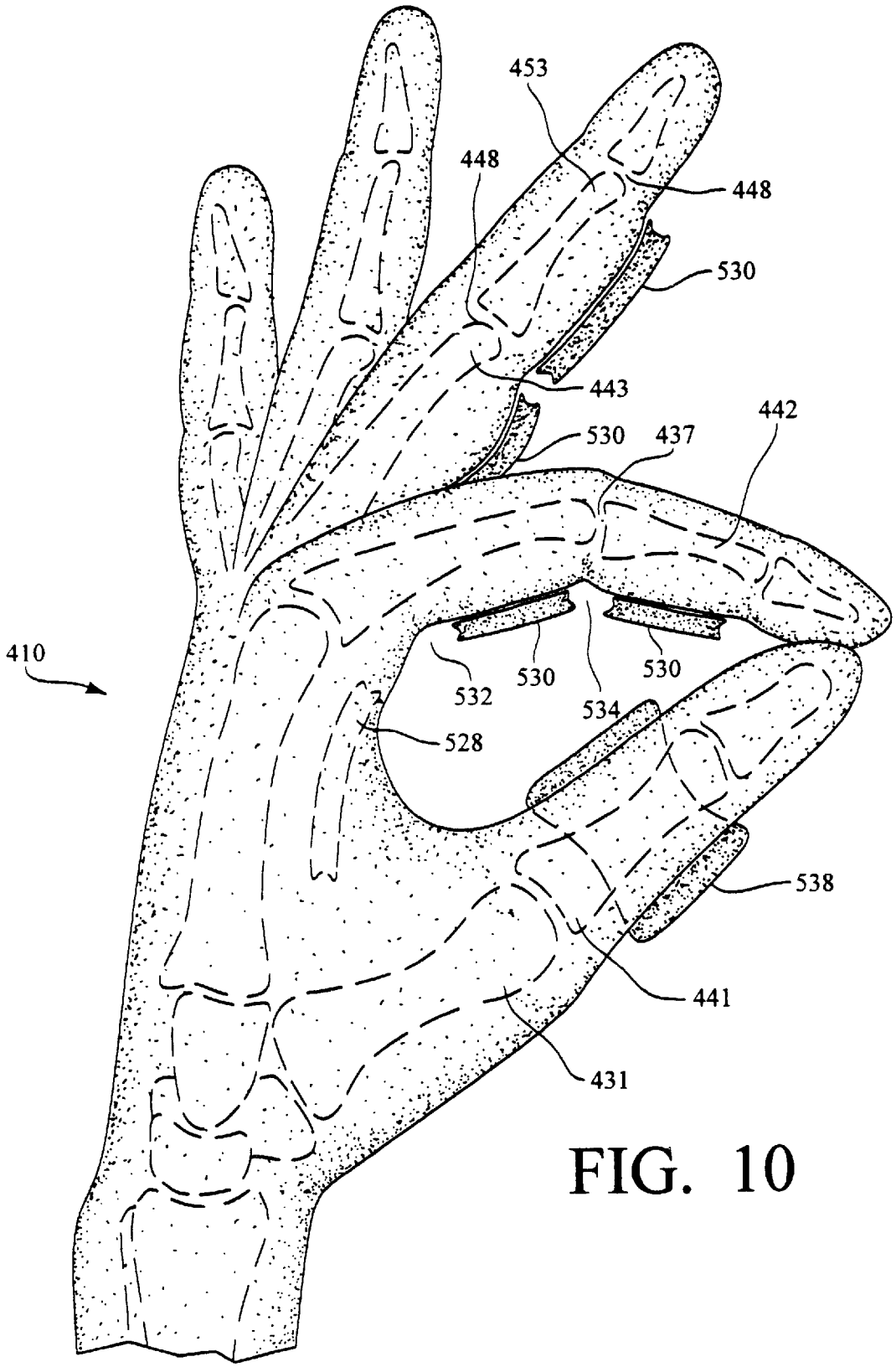
FIG. 10 is a radial side view of a catcher's mitt of the first preferred embodiment of FIG. 8 showing relevant details and seen overlaying the skeletal structure of a left human hand.

In the first preferred-catcher's mitt as shown in FIGS. 8–10, a second layer of padding, which is generally a foam rubber or other foamed elastomeric material, is positioned to overlie, as shown in FIG. 6, at least a first area above and a second area below the center axis of rotation of the metacarpalphalangeal joint of the index finger. As shown in FIG. 8, the second layer of padding, identified by the numeral 528, overlies the distal halves of the second and third metacarpals 432, 433 excluding the metacarpalphalangeal joints 437, 438 (FIG. 7). The second layer of padding does not extend over the distal ends of the metacarpal 432, 433 which is adjacent the metacarpalphalangeal joint 437, 438 as this area defines a primary motion zone 532. Also, as shown in FIG. 8, the second layer of padding as identified by the numeral 530, overlies the proximal phalanxes 442 and 443 of the index and long finger as well as the middle phalanxes 452 and 453 of the index and long fingers excluding the proximal interphalangeal joints 447, 448 which defines a secondary motion zone 534. The second layer of padding is also provided with a third area 538 where the A2 pulley 622 is attached to the proximal phalanx 441 of the thumb 464. Padding for the catcher's mitt in the second layer, usually a foam rubber or a foamed plastic, is generally about ¼" thick and attached to the top side of the bottom wall 502, as best shown in FIG. 9. As shown in FIG. 10, the protective second layer of protective padding 528 and 530, for the fingers 465 and 466 and the thumb 464, is placed in an anatomically designed fashion over the A1, A2 and A4 pulley regions with the primary and secondary motion zones 532 and 534, respectively, being left free. This enables the movement of the fingers and thumb without any adverse effects in use as a catcher's mitt.

Figure 11:
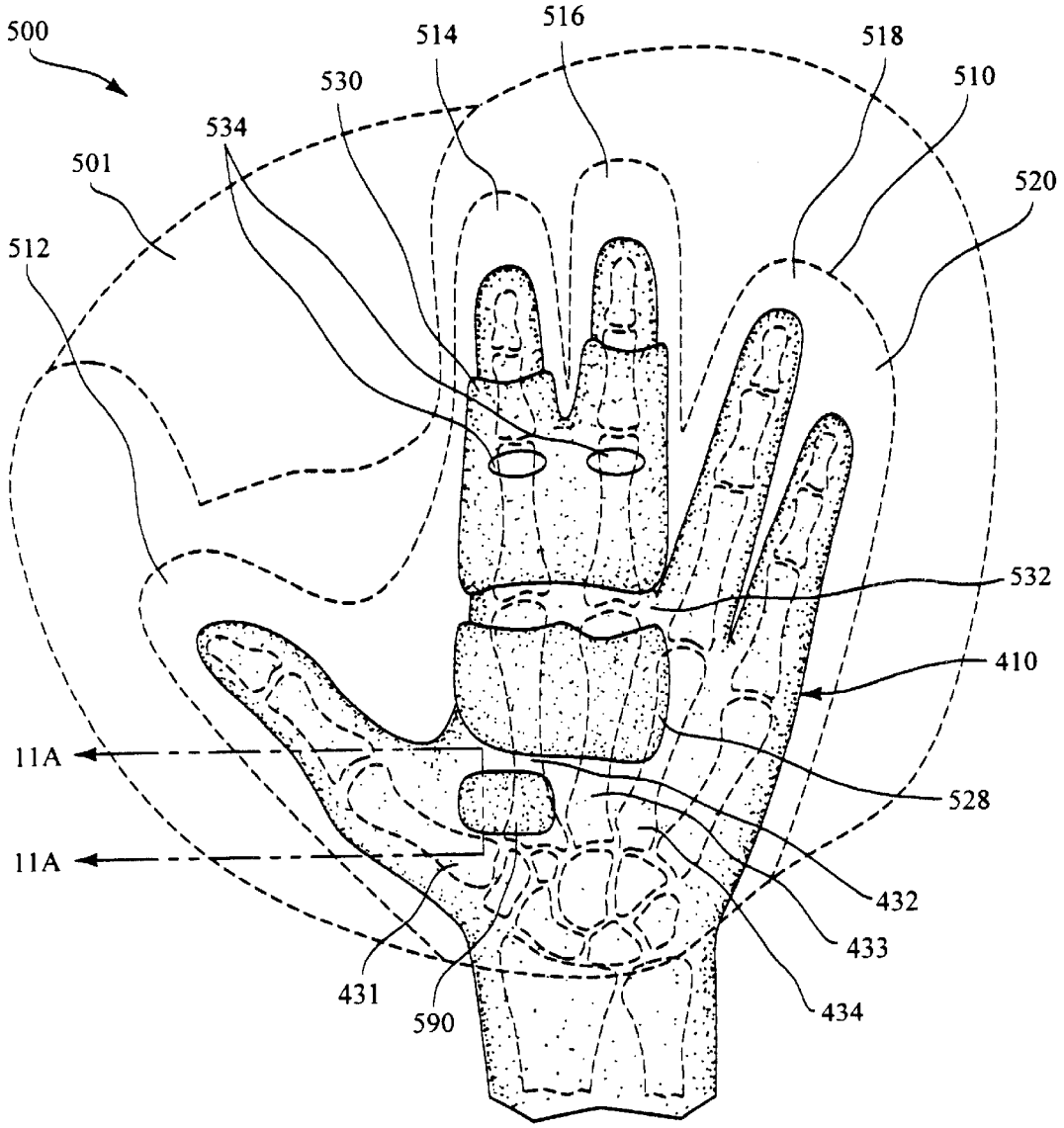
FIG. 11 is a top view of a second embodiment of a catcher's mitt showing the palmar side details and seen overlaying the skeletal structure of a left/palmar side human hand inserted in a catcher's mitt with the outline of the catcher's mitt shown in phantom lines.

As shown in FIG. 11, a second embodiment of a catcher's mitt of the present invention is shown. In this embodiment, a fourth area 590 of the second layer of padding overlies the proximal phalanx 431 of the thumb between the bony prominences. This area 590 of padding acts as a thumb support relief component. Moreover, the area of the second layer of padding, as identified by the numeral 588 overlies a portion of the A2 pulley of the proximal phalanx 434 of the ring finger.

Figure 12:
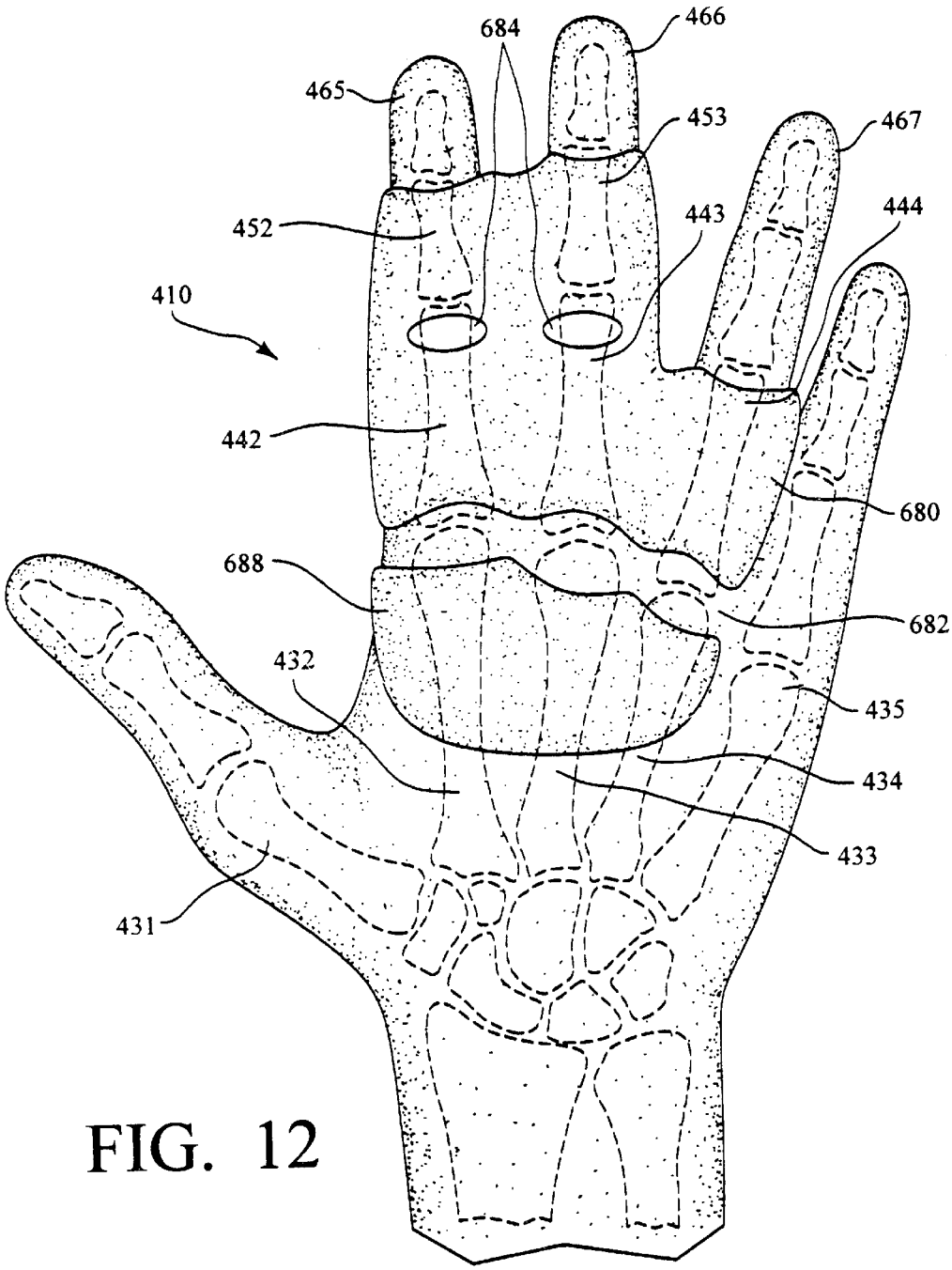
FIG. 12 is a top view of a third embodiment of a catcher's mitt showing the palmar-side detail and seen overlaying the skeletal structure of a left-palmar-side human hand.

As shown in a third embodiment of a catcher's mitt in FIG. 12, the areas of the second layer of foam padding have been extended to cover the areas of the distal half of the metacarpal 434 and the proximal phalanx 444 of the ring finger 467 excluding the metacarpalphalangeal joint 439 in addition to overlying the areas of the index finger 465 and the long finger 466 as discussed previously in regards to FIG. 8. These extended areas of padding are identified by numerals 688 and 680, respectively. Moreover, the primary motion zone 682 is extended to cover the distal end of the metacarpal 434 which is adjacent the metacarpalphalangeal joint 439.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A catcher's mitt comprising:

a top wall and a bottom wall secured along each wall's outer periphery to define a mitt body;

a top panel secured to the top wall with an opening therein to receive a human hand, said top panel member sized to cover a back of said hand and in conjunction with said top wall providing a thumb stall and a plurality of finger stalls for receiving a thumb and fingers of said human hand;

said mitt body having a first layer of protected padding disposed throughout said mitt body;

said top wall having a second layer of protective padding attached at selected areas thereof, said selected areas being defined by the location of anatomical parts of the human hand when inserted into said mitt, said second layer of padding including a first area adapted to be above and a second area adapted to be below the center axis of rotation of a metacarpalphalangeal joint of an index finger, said metacarpalphalangeal joint of said index finger being absent of said second layer of padding.

2. The mitt of claim 1, said second layer of protective padding being approximately ¼" thick.

3. The mitt of claim 2, said second layer of protective padding being a foam rubber or a foamed plastic.

4. The mitt of claim 1, said second layer of protective padding including a third area adapted to be above the center axis of rotation of a proximal interphalangeal joint of a long finger.

5. The mitt of claim 1, said second layer of protective padding including a fourth area adapted to be below the center axis of rotation of a proximal interphalangeal joint of a longer finger.

6. The mitt of claim 1, said second layer of protective padding including a fifth area adapted to be above the center axis of rotation of a metacarpalphalangeal joint of a ring finger.

7. The mitt of claim 1, said second layer of protective padding including a sixth area adapted to be below the center axis of rotation of a metacarpalphalangeal joint of a ring finger.

8. The mitt of claim 1, said second layer of protective padding including a seventh area adapted to be above the center axis of rotation of a metacarpalphalangeal joint of a small finger.

9. The mitt of claim 1, said second layer of protective padding including a eighth area adapted to be below the center axis of rotation of a metacarpalphalangeal joint of a small finger.

10. The mitt of claim 1, said second layer of protective padding including a ninth area adapted to be overlying the bony prominences of the thumb proximal phalanx between the proximal and distal ends of the thumb proximal phalanx.

11. The mitt of claim 1, said second layer including a tenth area adapted to be overlying the proximal phalanx of the thumb between the bony prominences.

12. The mitt of claim 1, said first and second areas defining a primary motion zone at the distal end of the metacarpal of the index finger.

13. In a baseball catcher's mitt having a top wall and a bottom wall defining a mitt body with a first layer of protective padding therein and a top panel member secured to the top wall with an opening therein to receive a human hand, the top panel member and the top wall providing a thumb stall and a plurality of finger stalls for receiving a thumb and fingers of the human hand, the improvement comprising:

a second layer of protective padding attached at selected areas along an underside of said top wall, said selected areas being defined by the location of anatomical parts of the human hand when inserted into said mitt, said second layer of protective padding having a first area adapted to be above and a second area adapted to be below the center axis of rotation of a metacarpalphalangeal joint of an index finger, said metacarpalphalangeal joint of said index finger being absent of said second layer of padding.

14. The mitt of claim 13, said second layer of protective padding being ¼" in thickness.

15. The mitt of claim 14, said second layer of padding being a foam rubber or a foamed plastic.

16. The mitt of claim 13, said second layer of protective padding including a third area adapted to be above the center axis of rotation of a proximal interphalangeal joint of a long finger.

17. The mitt of claim 13, said second layer of protective padding including a fourth area adapted to be below the center axis of rotation of a proximal interphalangeal joint of a long finger.

18. The mitt of claim 13, said second layer of protective padding including a fifth area adapted to be above the center axis of rotation of a metacarpalphalangeal joint of a ring finger.

19. The mitt of claim 13, said second layer of protective padding including a sixth area adapted to be below the center axis of rotation of a metacarpalphalangeal joint of a ring finger.

20. The mitt of claim 13, said second layer of protective padding including a seventh area adapted to be above the center axis of rotation of a metacarpalphalangeal joint of a small finger.

21. The mitt of claim 13, said second layer of protective padding including a eighth area adapted to be below the center axis of rotation of a metacarpalphalangeal joint of a small finger.

22. The mitt of claim 13, said second layer including a ninth area adapted to be overlying the bony prominences of the thumb proximal phalanx between the proximal and distal ends of the thumb proximal phalanx.

23. The mitt of claim 13, said second layer including a tenth area adapted to be overlying the proximal phalanx of the thumb between the bony prominences.

24. The mitt of claim 13, said first and second areas defining a primary motion zone at the distal end of the metacarpal of the index finger.

* * * * *

UNITED STATES PATENT AND TRADEMARK OFFICE

CERTIFICATE OF CORRECTION

PATENT NO. : 6,415,444 B1
DATED : July 9, 2002
INVENTOR(S) : James M. Kleinert

It is certified that error appears in the above-identified patent and that said Letters Patent is hereby corrected as shown below:

Title page,
Item [75], Inventor, change "Glenview, KY" to -- Louisville, KY --;

Column 10,
Line 62, after "panel" insert -- member --;

Column 11,
Line 24, change "longer" to -- long --.

Signed and Sealed this

Second Day of September, 2003

JAMES E. ROGAN
*Director of the United States Patent and Trademark Office*